United States Patent [19]

Chardonneau et al.

[11] 4,063,825

[45] Dec. 20, 1977

[54] PUMPING APPARATUS PARTICULARLY FOR OIL WELLS

[75] Inventors: Jöel Chardonneau, Nantes; Claude Sablé, Reze, both of France

[73] Assignee: Centre d'Etudes et de Realisations Industrielles de l'Atlantique C.E.R.I.A., Nantes, France

[21] Appl. No.: 584,284

[22] Filed: June 6, 1975

[51] Int. Cl.[2] ..... F04B 17/00

[52] U.S. Cl. ..... 417/343; 74/242.15 R; 92/137

[58] Field of Search ..... 92/137, 85, 143; 74/603, 590, 589, 242.15 R, 242.1 TA, 242.1 FP; 417/343, 539, 328, 329

[56] References Cited

U.S. PATENT DOCUMENTS

| | | | |
|---|---|---|---|
| 300,665 | 6/1884 | Vandervoort | 92/85 A |
| 476,398 | 6/1892 | Long | 417/329 |
| 961,039 | 6/1910 | Starr | 417/550 X |
| 1,359,644 | 11/1920 | Wright | 74/590 X |
| 1,499,240 | 6/1924 | Manry | 417/539 |
| 1,970,620 | 8/1934 | Park | 74/590 X |
| 2,150,293 | 3/1939 | Pugh | 417/343 X |
| 2,229,115 | 1/1941 | Murray | 74/590 X |
| 2,341,864 | 2/1944 | Grumbaugh | 417/390 |
| 2,613,915 | 10/1952 | Stone | 92/137 X |
| 3,464,317 | 9/1969 | Woodward | 92/137 X |
| 3,709,105 | 1/1973 | Ridley | 92/137 |
| 3,749,525 | 7/1973 | Hooper et al. | 417/343 X |
| 3,839,865 | 10/1974 | Chardonneau et al. | 60/382 X |

FOREIGN PATENT DOCUMENTS

| | | | |
|---|---|---|---|
| 140,016 | 3/1902 | Germany | 74/590 |

*Primary Examiner*—William L. Freeh
*Assistant Examiner*—Edward Look
*Attorney, Agent, or Firm*—Cushman, Darby & Cushman

[57] ABSTRACT

A pair of pumps which are joined by a flexible connection passing over a rotatable device positioned for rotation in a substantially vertical plane. The rotatable means is driven alternately in clockwise and counterclockwise directions whereby the lifting of one pump occurs as the other pump is lowered.

5 Claims, 4 Drawing Figures

PUMPING APPARATUS PARTICULARLY FOR OIL WELLS

BACKGROUND OF THE INVENTION

The present invention relates generally to pumping devices, and more particularly refers to petroleum pumping devices used especially for offshore production fields.

Pumping devices of this type are already known which contain a drive device which, with the aid of flexible connection attached to a train of rods of the production well, imparts to the rods a reciprocating movement whose frequency and amplitude are adjustable. The drive device usually comprises a hydraulic motor, on the output shaft of which is fastened a toothed wheel meshing with a flexible connection, which usually comprises a link chain, the motor being fed by a variable delivery hydraulic pump the delivery of which is controlled in accordance with a cycle determined by the required movement of the train of rods. The end of the chain opposite to the train of rods is then fixed to a counterweight, the value of this is calculated in dependence on the weight of the train of rods, and in dependence on the pumping force to be supplied, that is to say the mass of the column of fluid to be pumped. This counterweight is generally equivalent to the sum of the mass of the train of rods and half that of the column of fluid pumped.

A counterweight of this kind makes it possible to reduce considerably the motive power required, but because of its mass (up to 5 metric tons in certain cases) and its stroke (which is that of the pump, that is to say of the order of from 2 to 10 meters) it entails disadvantages, because it increases considerably the size of the pumping apparatus.

SUMMARY OF THE INVENTION

The invention seeks, if not to eliminate entirely this couterweight, at least to reduce its mass considerably.

It is an object of the invention to provide a pumping apparatus, particularly for oil wells, comprising at least one drive device capable of imparting, through the medium of a flexible connection means having two pendent runs, a permanent reciprocating movement to a pump unit, wherein the said pump unit comprises two separate pumps situated near one another and connected respectively to the ends of the said pendent runs.

When the pumps are of practically identical power, the flexible connection means alone may be sufficient without effecting balancing of the forces applied to the pendent runs of the flexible connection means, these forces then being practically equal.

According to another characteristic of the invention, which is applicable particularly when the pumps have slightly different powers, the drive device is associated with a second auxiliary flexible connection means having two pendent runs, to which it applies a permanent reciprocating movement synchronous with that of the main flexible connection means; while a resistant device attached to the pendent runs of the said auxiliary flexible connection means is provided.

According to yet another characteristic of the invention, which is applicable more particularly when the powers of the pumps are significantly different, the pumping apparatus comprises two drive devices capable of imparting, through the medium of the said flexible connection means, a permanent reciprocating movement to the said pumps, while in addition a resistant device is provided which is capable of applying to a loop formed in the said flexible connection means, between the points where force is applied to the said connection means by the said drive devices, a resistant force directed parallel to the said pendent runs.

As the result of these characteristics the dimensions of the pumping apparatus can be considerably reduced and, particularly when the resistant device is composed of one or more counterweights, the mass of the latter can be substantially reduced.

DESCRIPTION OF THE PREFERRED EMBODIMENTS

Figure 1:
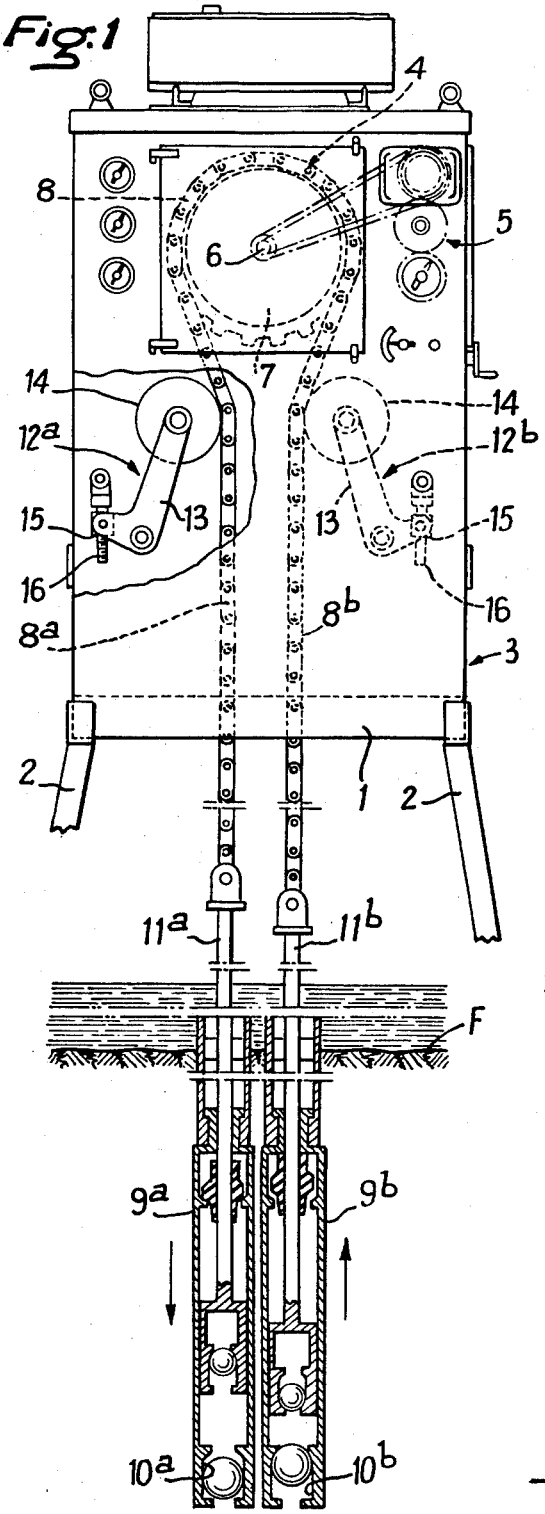
FIG. 1 is a diagrammatical view in elevation, partly broken away, of a pumping apparatus constructed according to a first embodiment of the invention.

In the form of construction of the pumping apparatus which is shown in FIG. 1, a platform 1 is provided which rests on the seabed F with the aid of a frame 2 of suitable shape. On the platform 1 is mounted a housing containing in particular a drive device 4 and a movement control device 5.

These devices may be of any type known in the art, but it is preferable that they should be designed according to the arrangements described in our U.S. Patent application Ser. No. 584,285 filed on June 6, 1975 now U.S. Pat. No. 3,959,967 for: "Reciprocating drive device".

It is sufficient to indicate here that the Drive Device 4 preferably comprises a pump which is, for example, driven by an electric motor and which is of the variable delivery type. This pump feeds a hydraulic motor with a flow dependent on the position of the control element of the pump.

The movement control device 5 preferably comprises mechanical and hydraulic elements which establish connection between the pump control element and the output shaft of the hydraulic motor in such a manner that the latter effects a reciprocating rotational movement whose frequency and amplitude are determined accurately and adjustably.

The output shaft of the hydraulic motor, which bears the reference 6 in FIG. 1, drives a toothed wheel 7 meshing with a flexible connection means, such as a link chain 8. The latter thus has two vertical pendent runs of chain links **8*a* and 8*b***.

According to the invention, these two runs **8*a* and 8*b* of the chain 8 are connected to two petroleum pumps 9*a* and 9*b*, which are known per se and which are inserted into oil wells 10*a* and 10*b* at the same location or situated close to one another and drilled in the seabed F. The petroleum pumps 9*a* and 9*b*, which work in opposition, are attached to the runs 8*a* and 8*b* with the aid of trains of rods 11*a* and 11*b*** of conventional type.

FIG. 1 shows that guide devices **12*a* and 12*b* are accommodated in the housing 3 in order to permit adaptation of the distance between the runs 8*a* and 8*b* to the distance separating the petroleum pumps 9*a* and 9*b***.

Each of these guide devices comprises a bent lever 13 articulated on the frame of the housing 3 and carrying, at one end, a freely rotatable pulley 14 which is in contact with the corresponding run 8*a* or 8*b* of the chain 8.

The other end of each bent lever 13 is articulated on a threaded block 15 which is screwed on a threaded rod 16, the latter in turn being articulated on the frame of the housing 3, while able to rotate about its own axis.

It is advantageous for the trains of rods 11*a* and 11*b* to have equal masses, so that the dead weights of the moving masses are balanced as far as possible. There is thus no question of balancing the mass of the column of pumped fluid by means of a counterweight, as in the prior art. Since in the case of FIG. 1 these forces are identical, the counterweight can be completely eliminated, thus substantially reducing the space required on the platform and the mass which the latter has to support. This is very important for sea working platforms fixed to the seabed, where problems of surface space and weight of equipment are of major importance.

Figure 3:
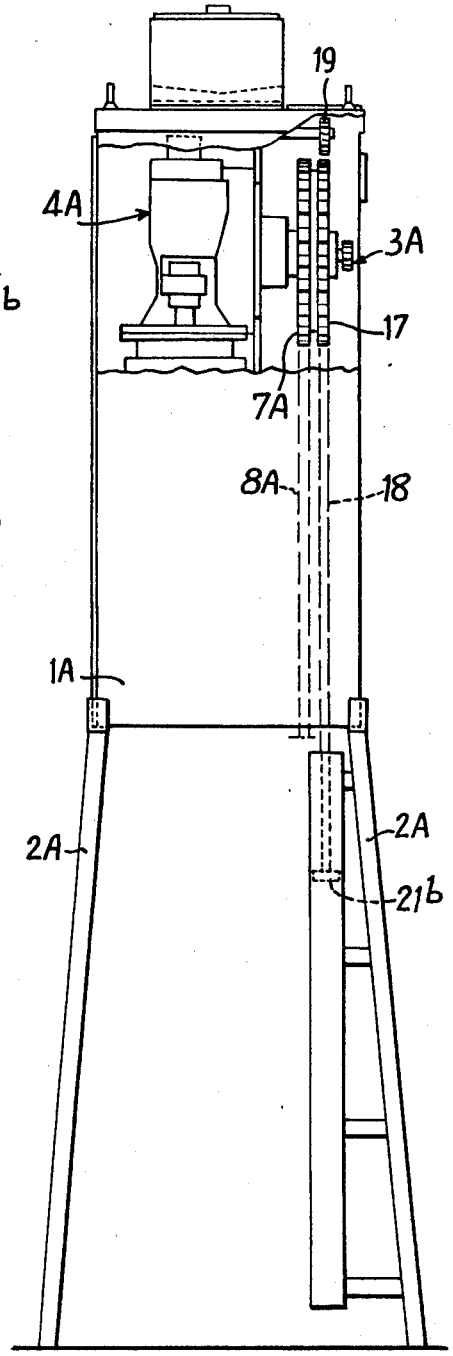
FIG. 3 is a partial side view of the apparatus shown in FIG. 2, taken on the line 3—3 in that Figure.
Figure 2:
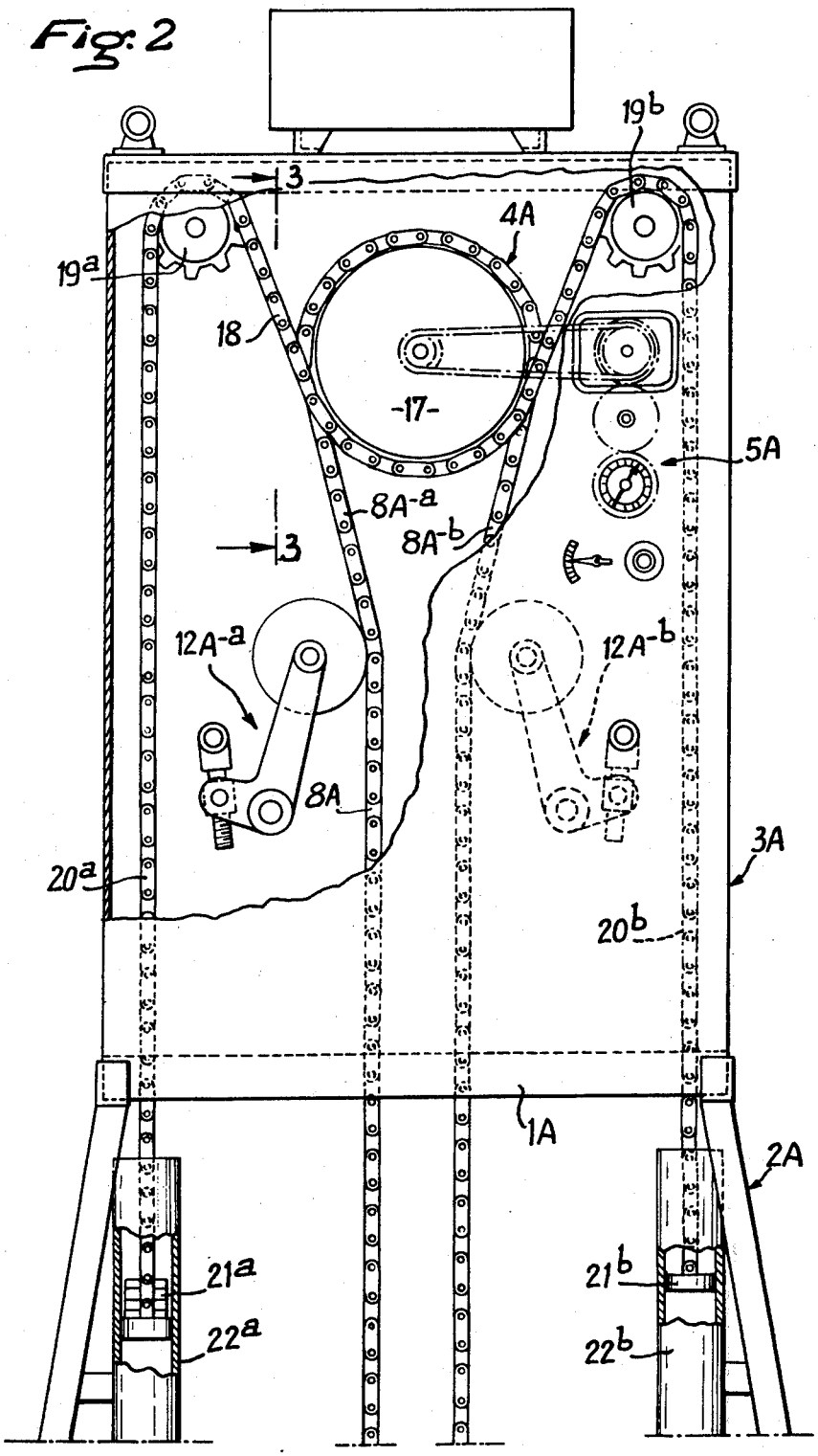
FIG. 2 is a similar view of a pumping apparatus according to a second embodiment.

FIGS. 2 and 3 show another embodiment of the invention which is applicable to the case where the pumping forces of the two pumps for the wells are not equal. The apparatus shown comprises a frame work 2A supporting a platform 1A, on which is mounted a housing 3A containing a drive device 4A and a movement control device 5A, these devices being identical to the devices 4 and 5 in FIG. 1.

On the output shaft 6A of the drive device 4A is fastened a main sprocket wheel 7A engaging with a link chain 8A co-operating with pumps of different powers (not visible in the drawings) for the oil wells. The distance between the descending runs of this chain 8A is adjusted by adjustment devices 12*a*-A 12A-*a* and 12*b*-A 12B-*b* which are identical with those in FIG. 1.

An auxiliary wheel 17 is fastened on the output shaft 6A. This wheel meshes with an auxiliary chain 18, which also passes over two auxiliary return sprocket wheels 19*a* and 19*b* disposed at the top of the apparatus, one on each side of the wheels 7A and 17.

The chain 18 has two descending runs 20*a* and 20*b*, to the ends of which are fastened respectively counterweights 21*a* and 21*b* of different, adjustable weights. These weights are displaced vertically in guides 22*a* and 22*b* fastened to the framework 2A.

The counterweights 21*a* and 21*b* are arranged to apply a constant torque to the wheel 7A driving the main chain 8A.

The torque has a driving action on the run of this chain which bears the heavier load (in this particular case the run 8A-*b*) and a reverse action on the other run (8A-*a*). On the main chain 8A this torque produces a force *Fe*, which is always applied in the same direction.

This force is optimum if:

$$Fe = (p - p)/2,$$

in which:

*P* is the force required by the pumping from the drive device 4A on the more heavily loaded side;

*p* is the force required on the less heavily loaded side.

With the counterweight of value *Fe* the equations for the two cases become respectively:

$$P - Fe = (P + p)/2$$

instead of *P*, and $$P - Fe = (p + P)/2$$

instead of *p*.

In order to control the balancing of the system, the oil pressures applied to the drive device 4A for the two directions of rotation can be read on instruments provided for the purpose, balancing being achieved when these pressures are equal.

It should be noted that the counterweight 21*b* of low value merely tensions the corresponding run 20*b* of the auxiliary chain 18.

It will also be observed that the same effect can be obtained by replacing the counterweights 21*a* and 21*b* by power cylinders whose rods are attached to the auxiliary chain 18, and which function on a compensated accumulator.

It is also possible to provide a hydraulic motor whose output shaft will be fastened to the shaft of one of the return pulleys 19*a* or 19*b*. A motor of this kind could act as a return spring similar to the power cylinder referred to above.

Other resilient devices could also be provided as alternatives.

In the embodiment described the mass of the counterweight constitutes half the difference between the forces required of the drive device 4A. The arrangement therefore provides the advantage of using a lighter counterweight than in the prior art.

Furthermore, the alternatives indicated above, using other resistant devices such as power cylinders, resistant motors, or the like, provide the additional advantage of being of smaller dimensions.

Figure 4:
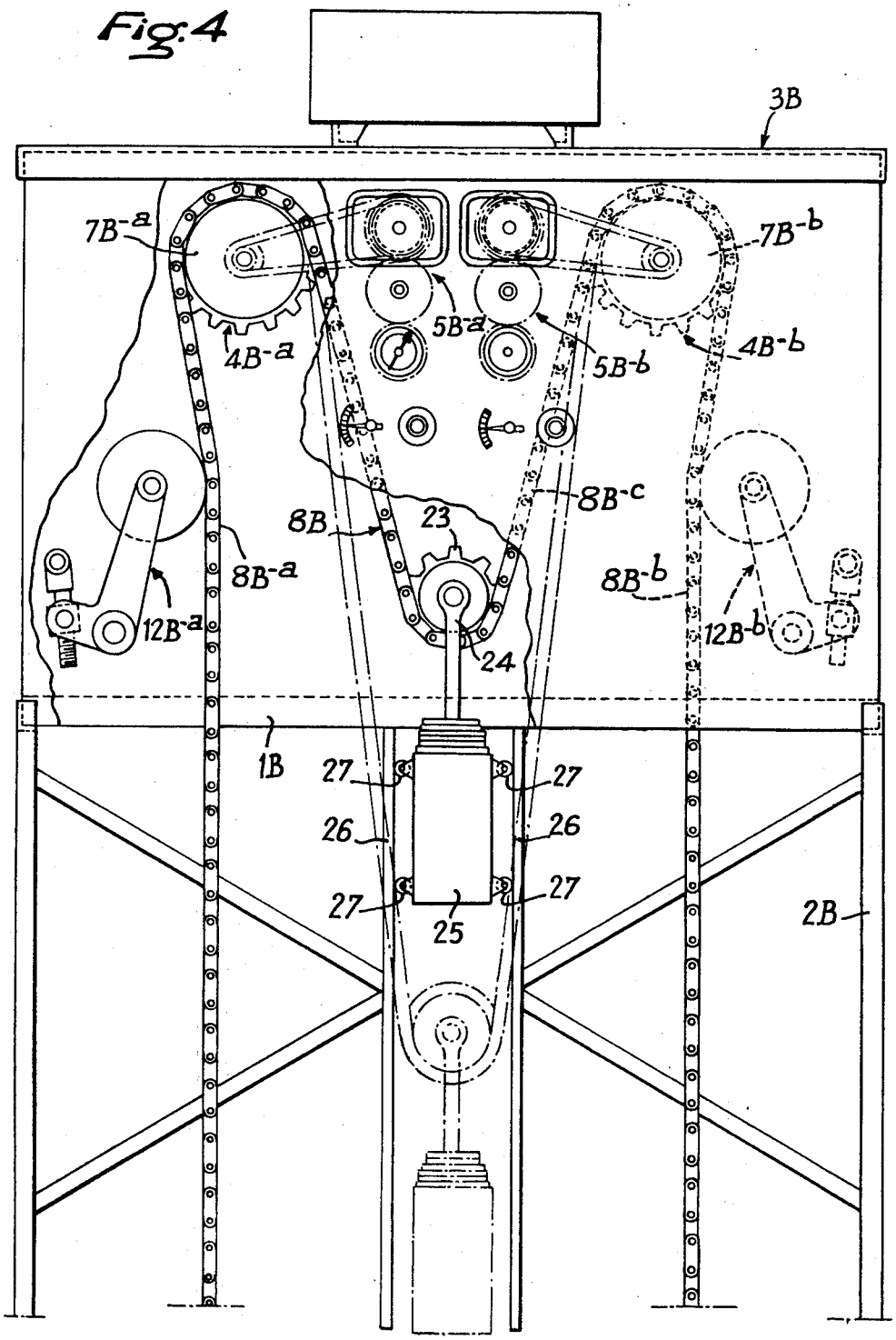
FIG. 4 shows a pumping apparatus constructed in accordance with a third embodiment of the invention.

FIG. 4 shows a third embodiment of the invention. In this case a single chain 8B is provided, which is attached by its two descending runs 8B-*a* and 8B-*b* to trains of rods of two petroleum pumps of very different powers.

The chain 8B is guided by two adjusting devices 12B-*a* and 12B-*b* which are identical to those previously described. The chain 8B is driven by two drive devices 4B-*a* and 4B-*b* which are identical and are placed side-by-side in a housing 3B resting on a platform 1B, which in turn is supported by a framework 2B. Each drive device 4B-*a* or 4B-*b* is driven by its own movement control device 5B-*a* or 5B-*b* respectively.

Each drive device drives a sprocket wheel 7B-*a* or 7B-*b*, around which the chain 8B passes. The chain also passes over a pulley 23 which is supported in a loop 8B-*c* formed between the sprocket wheels 4B-*a* and 4B-*b*. The pulley 23 is free to turn in a yoke 24 on which is fixed a central counterweight 25, which is in the form of a carriage adapted to move vertically between two vertical rails 26 with the assistance of rollers 27. The rails are rigidly fastened to the framework 2B.

In this embodiment balancing is effected by using for the counterweight the means common to the forces of the two petroleum pumps.

The following equation may be posed:

$$X = T_1 + T_2 + (F_1 + F_2)/2$$

in which:

$T_1$ = weight of the train of rods of the first well;

$T_2$ = weight of the train of rods of the second well;

$F_1$ = mass of the column of fluid of the first well;

$F_2$ = mass of the column of fluid of the second well;

$X$ = mass of the counterweight 25.

The force applied to each run of the chain is then:

$$X/2 = (T_1 + T_2)/2 + (F_1 + F_2)/4.$$

Although this arrangement is more complicated than the previous embodiment, in respect of the driving part, it has the advantage that the mass of the counterweight is reduced and it is possible to use one of the wells when the other has to be put out of service, for example for maintenance purposes. It is in fact than sufficient to fix the corresponding run of the chain.

It should be noted that certain parts of the drive devices 4A and 4B may be common to both of them, for example: the drive motor of the variable delivery pumps, the oil reservoirs, the oil cooling circuits, etc.

It will also be observed that instead of the link chain the pumping apparatus may utilise one or more cables wound around a grooved driving drum in one or more layers, in which case the drum replaces the sprocket wheel described.

We claim:

1. Balanced pumping apparatus for the extraction of fluid material, such as petroleum, from two wells comprising:

shaft-mounted rotatable means positioned for rotation in a substantially vertical plane;

flexible connection means passing over said rotatable means in operative relationship therewith and having downwardly extending ends located on opposite sides of the rotatable means;

a train of rods connected to each end of the flexible connection means, said train of rods joined to pumps being located within respective wells and mounted for reciprocating vertical movement therein;

means for rotating said rotatable means alternately in clockwise and counterclockwise directions whereby when one of said trains of rods is lifted by said flexible connection means, the other train of rods is lowered, the lifting of said one train of rods being aided by the weight of said other train of rods;

additional shaft-mounted rotatable means operatively related to said first mentioned rotatable means; and a second flexible connection joined in operative relationship with said additional rotatable means and having unequal resistant devices secured to ends thereof which extend downwardly on opposite sides of the additional rotatable means.

2. Apparatus according to claim 1, wherein the said resistant devices comprise counterweights.

3. Apparatus according to claim 1, wherein the said flexible connection means is in link chain, and the rotatable means comprises a sprocket wheel around which the said chain passes.

4. Apparatus according to claim 3, wherein for each of the said downwardly extending ends a guide device is provided for adjusting the end vertically in line with the said pump.

5. Apparatus according to claim 1, wherein said second flexible connection means is a link chain engaging said additional rotatable means which comprises a sprocket wheel driven rotationally by the rotating means.

* * * * *